US009780501B2

(12) United States Patent
Wu et al.

(10) Patent No.: US 9,780,501 B2
(45) Date of Patent: Oct. 3, 2017

(54) POWER CABLE CONNECTOR ASSEMBLY

(71) Applicant: FOXCONN INTERCONNECT TECHNOLOGY LIMITED, Grand Cayman (KY)

(72) Inventors: Jerry Wu, Irvine, CA (US); Jun Chen, Kunshan (CN)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 15/408,706

(22) Filed: Jan. 18, 2017

(65) Prior Publication Data

US 2017/0207583 A1 Jul. 20, 2017

(30) Foreign Application Priority Data

Jan. 19, 2016 (CN) ..... 2016 2 0046928 U

(51) Int. Cl.

| | |
|---|---|
| ***H01R 13/648*** | (2006.01) |
| ***H01R 13/66*** | (2006.01) |
| ***H01R 13/405*** | (2006.01) |
| ***H01R 13/504*** | (2006.01) |
| ***H01R 24/28*** | (2011.01) |
| *H01R 103/00* | (2006.01) |

(52) U.S. Cl.

CPC ..... *H01R 13/6683* (2013.01); *H01R 13/405* (2013.01); *H01R 13/504* (2013.01); *H01R 24/28* (2013.01); *H01R 2103/00* (2013.01)

(58) Field of Classification Search

CPC ..... H01R 13/6666

USPC ..... 439/620.08, 620.3, 620.31, 106, 913

See application file for complete search history.

(56) References Cited

U.S. PATENT DOCUMENTS

| | | | | |
|---|---|---|---|---|
| 5,315,476 | A * | 5/1994 | Hedrick | H01R 13/713 200/302.2 |
| 6,469,111 | B1 * | 10/2002 | Mihan | C08F 10/02 526/129 |
| 6,802,741 | B1 * | 10/2004 | Shatkin | H01R 13/7137 200/51 R |
| 7,029,327 | B2 * | 4/2006 | Devine | H01R 13/521 439/587 |
| 8,736,226 | B2 * | 5/2014 | Mukai | B60L 3/0069 320/104 |
| 2013/0013345 | A1 * | 1/2013 | Wallquist | G06Q 40/08 705/4 |

(Continued)

FOREIGN PATENT DOCUMENTS

| | | |
|---|---|---|
| CN | 104201519 | 12/2014 |

*Primary Examiner* — Phuong Dinh

(74) *Attorney, Agent, or Firm* — Wei Te Chung; Ming Chieh Chang

(57) ABSTRACT

A power cable connector assembly includes: an electrical connector including an insulative housing, a number of contacts retained in the insulative housing, and an outer case enclosing the insulative housing; a cable electrically connecting with the electrical connector, the cable including a number of core wires connected with corresponding contacts; and a sensor enclosed by the outer case, the sensor including a number of conductive wires connected with corresponding core wire; wherein the insulative housing defines a receiving cavity between two of the contacts, the sensor is inserted into the receiving cavity, and electrical transmission through said core wires is controlled by the sensor.

1 Claim, 5 Drawing Sheets

(56) References Cited

U.S. PATENT DOCUMENTS

| | | | | |
|---|---|---|---|---|
| 2013/0139097 | A1* | 5/2013 | Amano | G06F 3/033 715/781 |
| 2016/0104978 | A1 | 4/2016 | Chaumeny et al. | |
| 2016/0104988 | A1 | 4/2016 | Lee | |

* cited by examiner

POWER CABLE CONNECTOR ASSEMBLY

BACKGROUND OF THE INVENTION

1. Field of the Invention

The present invention relates to a cable connector assembly, especially to a stacked inner circuit board. This invention relates to a copending application Ser. No. 15/159,837 filed May 20, 2016 with the same applicant and the same assignee thereof.

2. Description of Related Arts

U.S. Patent Application Publication No. 2016/0104978, issued on Apr. 14, 2016, discloses an electrical apparatus comprising an electrically insulating body housing at least two electrical connection elements and a temperature sensor.

The temperature sensor is received in a thermally conductive and electrically insulating support element which is separate from and mounted inside the body.

U.S. Patent Application Publication No. 2016/0104988, issued on Apr. 14, 2016, discloses a power plug having a temperature sensor element positioned therein. The temperature sensor element may have a temperature sensor pin. When the temperature sensed by the temperature sensor element is higher than the first threshold value, the temperature element produces a first sense signal through the signal processing circuit. When the temperature sensed by the first threshold value, the temperature sensor element may transmit another sense signal.

A power cable connector assembly having an improved sensor mounting structure is desired.

SUMMARY OF THE INVENTION

An object of the present invention is to provide a power cable connector assembly having an improved sensor mounting structure.

To achieve the above-mentioned object, a power cable connector assembly includes: an electrical connector including an insulative housing, a plurality of contacts retained in the insulative housing, and an outer case enclosing the insulative housing; a cable electrically connecting with the electrical connector, the cable including a plurality of core wires connected with corresponding contacts; and a sensor enclosed by the outer case, the sensor including a plurality of conductive wires connected with corresponding core wire; wherein the insulative housing defines a receiving cavity between two of the plurality of contacts, the sensor is inserted into the receiving cavity, and electrical transmission through said core wires is controlled by said sensor.

Other objects, advantages and novel features of the invention will become more apparent from the following detailed description when taken in conjunction with the accompanying drawings.

DETAILED DESCRIPTION OF THE PREFERRED EMBODIMENT

Reference will now be made in detail to the preferred embodiment of the present invention.

Figure 1:
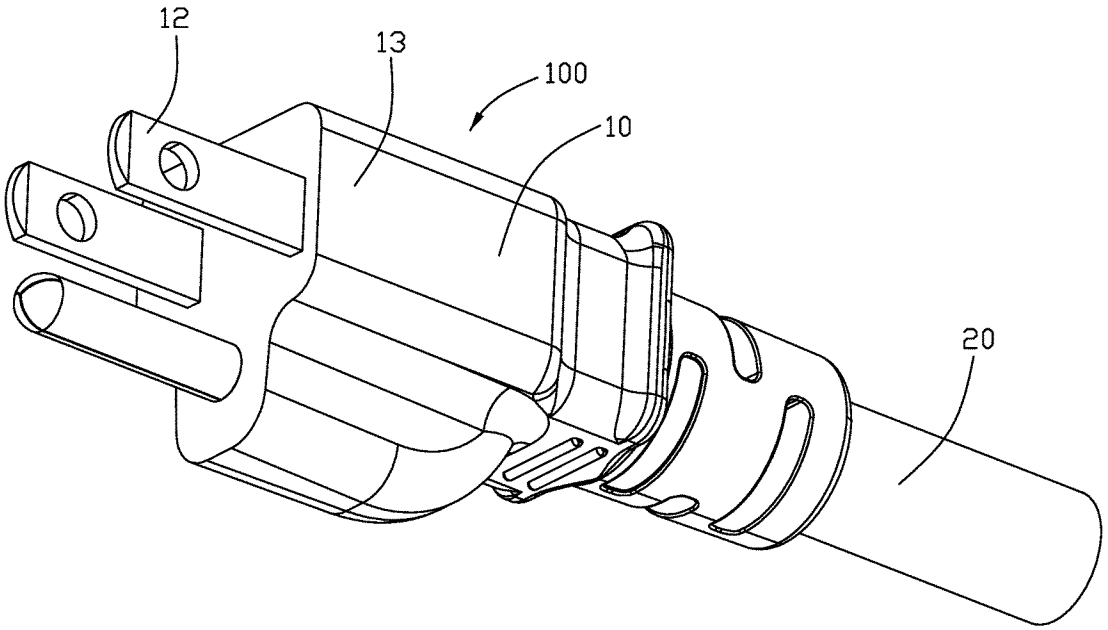
FIG. 1 is a perspective view showing a power cable connector assembly in accordance with the present invention.
Figure 2:
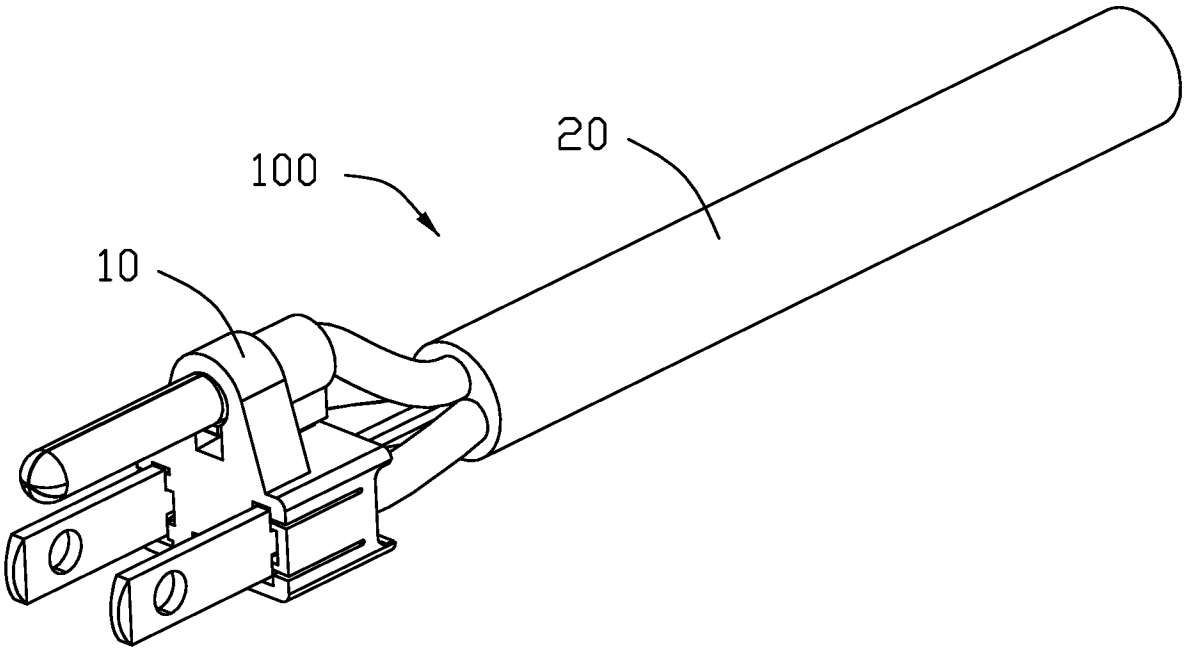
FIG. 2 is a perspective view showing the power cable connector assembly shown in FIG. 1, omitting an outer case.
Figure 3:
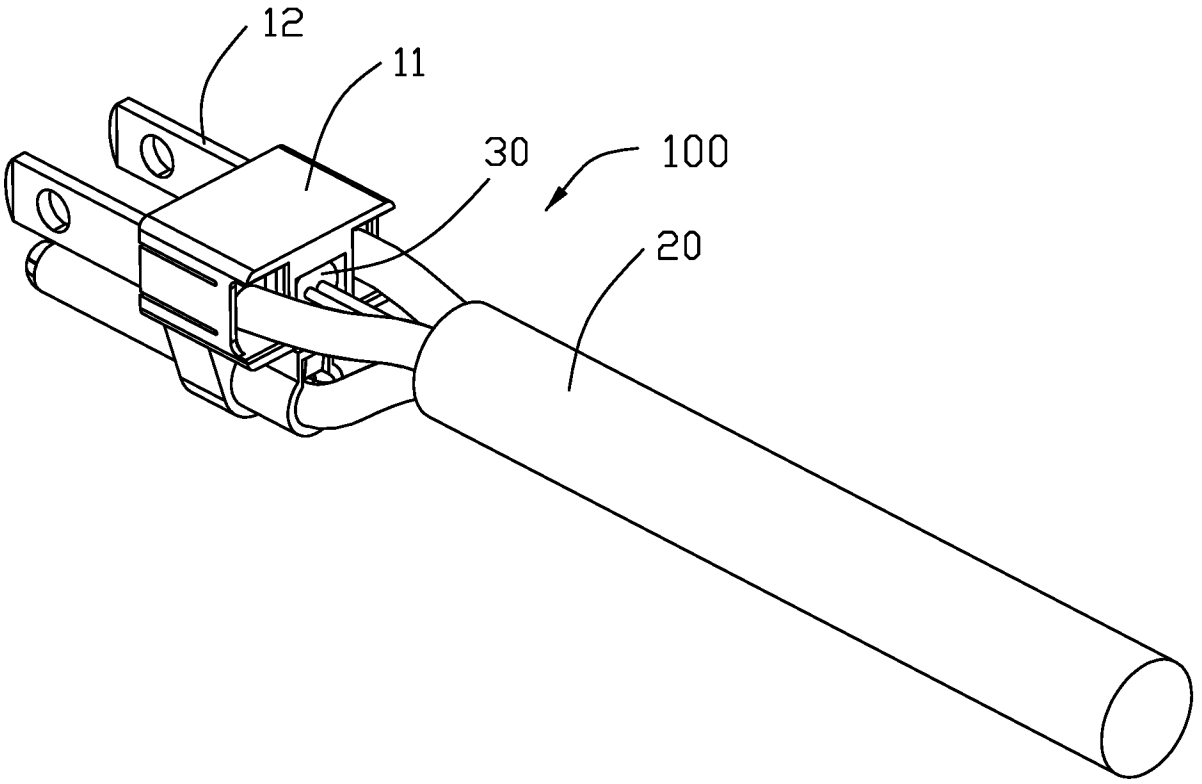
FIG. 3 is another perspective view showing the power cable connector assembly shown in FIG. 1, omitting an outer case.
Figure 4:
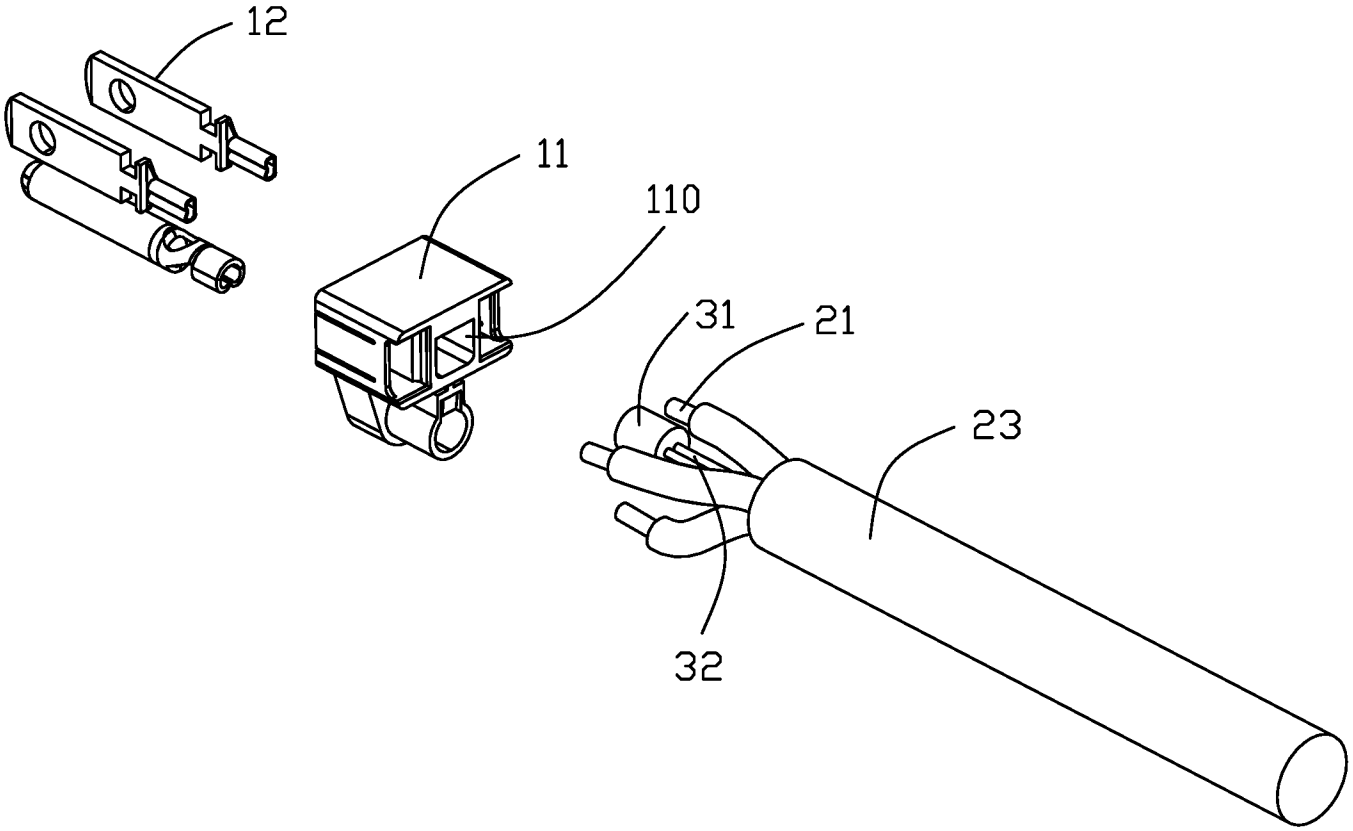
FIG. 4 is an exploded view of the power cable connector assembly as shown in FIG. 3.
Figure 5:
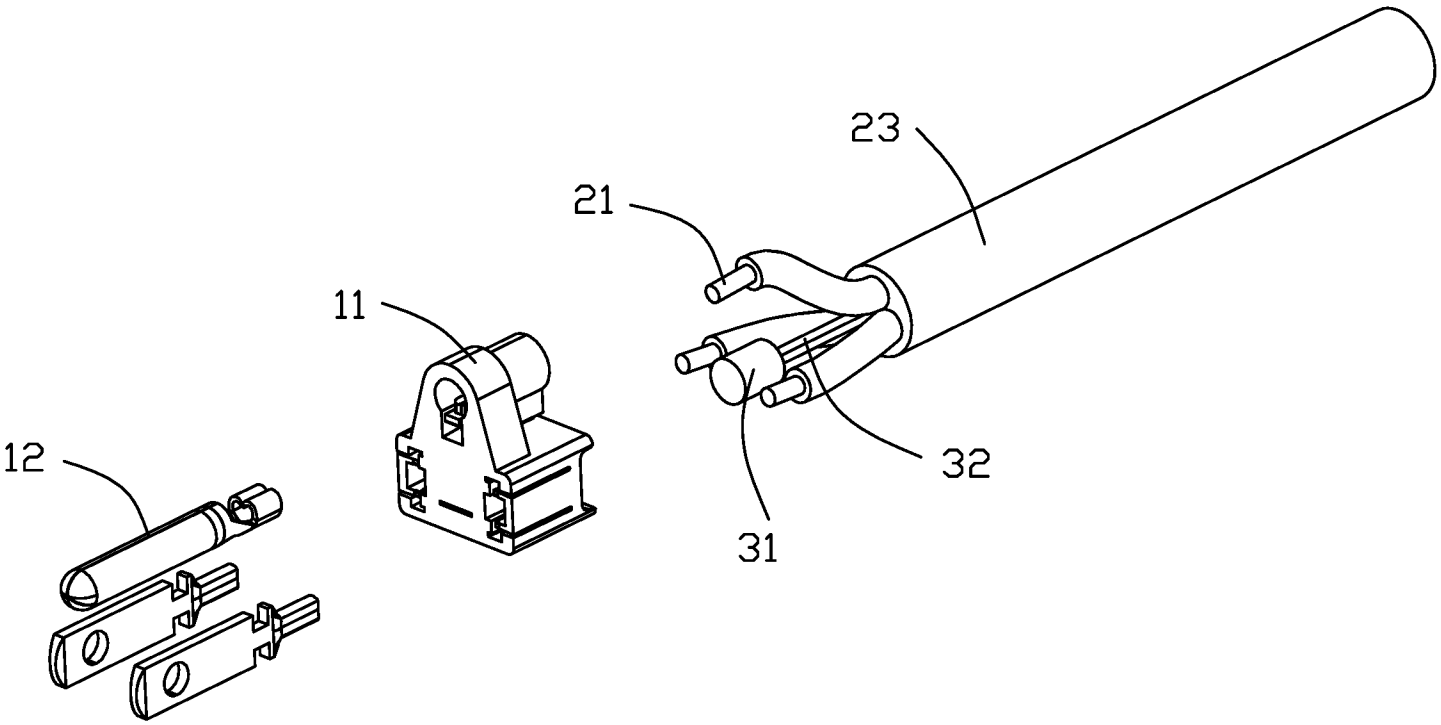
FIG. 5 is an another exploded view of the power cable connector assembly as shown in FIG. 2.

Referring to FIGS. 1-5, the power cable connector assembly 100 according to the present invention includes an electrical connector 10, a cable 20 connecting with the electrical connector 10, and a sensor 30. When the sensor 30 detects the heat exceeds a set value, the power cable connector assembly will drop-out current or drop-out voltage.

The power cable connector assembly 100 includes an insulative housing 11, a plurality of contacts 12 retained in the insulative housing 11 and an outer case 13 enclosing the insulative housing 11. The insulative housing 11 defines a receiving cavity 110. In the present embodiment, the number of the contacts 12 is three, and two of them are of sheet shape, and another is of columnar shape. In other embodiment, the number and the shape of contacts 12 are not limited. Users can set the appropriate number and shape according to the specific requirements and applications. The contacts 12 extend to expose to the outer case 13, for being inserted into a mating connector. In this embodiment, the three contacts 12 include a pair of blade type power contacts and a cylindrical grounding contact retained in the insulative housing 11 and arranged in an isosceles triangular form wherein the grounding contact is located at an apex and the pair of power contacts at two bottom corners, The material of the outer case 13 is insulation materials. The outer case 13 can be integrally molded in the outside of the insulative housing 11, or be mounted to the insulative housing 11 after being manufactured separately.

The cable 20 includes a plurality of core wires 21 electrically connected with the corresponding contacts 12, a controlling wires (not shown) electrically connected with the sensor 30, and an insulative layer covering the core wires 21 and control wire.

The sensor 30 includes a cylindrical main body 31 and a plurality of conductive wires 32 rearwardly extend from the main body 31. The conductive wire 32 is electrically connected with corresponding controlling wires (not shown). The main body 31 of the sensor 30 inserts into the receiving cavity 110 along a back-to-front direction and got stuck in the receiving cavity 110. When the power cable connector assembly 100 is charging, the resistance of the sensor 30 resistance will increase with the increase of heat, the power cable connector assembly will drop-out electric current or drop-out voltage until the resistance value exceeds a predetermined value. In this embodiment, the insulative housing 16 defines a receiving cavity between the pair of power contacts in a transverse direction, so the sensor is configured to be forwardly inserted into the receiving cavity, and electrical transmission through said core wires is controlled by the sensor; wherein said sensor is protected by the housing without experiencing improper impact applied upon the outer case.

The power cable connector assembly 100 accordance with the present invention detects the temperature by the sensor 30, thus has a high sensitivity and reliability.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the members in which the appended claims are expressed.

What is claimed is:

1. A power cable connector assembly comprising:

an electrical connector including an insulative housing, a pair of blade type power contacts and a cylindrical grounding contact retained in the insulative housing and arranged in an isosceles triangular form wherein the grounding contact is located at an apex and said pair of power contacts at two bottom corners, and an outer case enclosing the insulative housing;

a cable electrically connecting with the electrical connector, the cable including a plurality of controlling wires connected with corresponding power contacts and grounding contact; and a sensor enclosed within the outer case and including a plurality of conductive wires electrically connected with corresponding controlling wire; wherein the insulative housing defines a receiving cavity between the pair of power contacts in a transverse direction, the sensor is configured to be forwardly inserted into the receiving cavity, and electrical transmission through said core wires is controlled by said sensor; wherein said sensor is protected by the housing without experiencing improper impact applied upon the outer case, wherein said receiving cavity is only rearwardly open for allowing forward insertion of the sensor; wherein the sensor includes a main body and said plurality of conductive wires rearwardly extend from the main body; further including an outer case over-molded upon the insulative housing to shield the receiving cavity and the sensor therein.

* * * * *